United States Patent [19]

Kennington

[11] 4,296,824

[45] Oct. 27, 1981

[54] NOZZLE PLACEMENT IN LARGE DIAMETER EARTH BORING BITS

[75] Inventor: Kerry S. Kennington, Houston, Tex.

[73] Assignee: Hughes Tool Company, Houston, Tex.

[21] Appl. No.: 920,561

[22] Filed: Jun. 29, 1978

[51] Int. Cl.[3] ..... E21B 10/18

[52] U.S. Cl. ..... 175/340; 175/422

[58] Field of Search ..... 175/65, 67, 69, 71, 175/212, 213, 339, 340, 393, 422, 215

[56] References Cited

U.S. PATENT DOCUMENTS

| | | | |
|---|---|---|---|
| 2,949,281 | 8/1960 | Baur et al. | 175/340 X |
| 3,360,061 | 12/1967 | Canalizo | 175/71 X |
| 3,393,756 | 7/1968 | Mori | 175/422 X |
| 3,414,070 | 12/1968 | Pekarek | 175/393 |
| 3,417,829 | 12/1968 | Acheson et al. | 175/67 |
| 3,648,788 | 3/1972 | McKinney | 175/69 X |
| 3,841,421 | 10/1974 | Matsushita | 175/212 |

*Primary Examiner*—James A. Leppink
*Assistant Examiner*—George A. Suchfield
*Attorney, Agent, or Firm*—Robert A. Felsman

[57] ABSTRACT

Disclosed herein is a large diameter earth boring bit with improved nozzle placement. The bit is of the type having a cutter support with several rotatable cutters mounted below. The bit is connected to a string of pipe having an input and a return flow passage. Nozzles are located on the cutter support for the discharge of fluid onto the borehole bottom to sweep cuttings into an intake port in the cutter support. An outer zone nozzle is located at the periphery of the cutter support for cleaning the gage area of the borehole.

Several inner zone nozzles are spaced between the periphery and the intake port. The inner zone nozzles are positioned so that the area of influence of each nozzle overlaps with its next inward nozzle. This creates a continuous stream that entrains cuttings and sweeps them to the intake.

6 Claims, 3 Drawing Figures

NOZZLE PLACEMENT IN LARGE DIAMETER EARTH BORING BITS

BACKGROUND OF THE INVENTION

1. Field of the Invention

This invention relates in general to earth boring drill bits, and in particular to nozzle placement in large diameter earth boring bits.

2. Description of the Prior Art

This invention concerns large diameter bits, typically ranging in diameter from four feet to fifteen feet, that are used for drilling shafts for mining and other purposes. These bits have a generally circular cutter support plate with a number of rotatable cutters mounted to the plate bottom. The bit is rotated by a string of drill pipe. Cuttings are cleaned from the borehole by circulating fluid.

In one prior art method, a mixture of air and liquid is pumped down the annular passage between the inner and outer drill pipe of a string of dual concentric pipe. In a diffuser the air separates from the water and enters the inner passage through a set of air nozzles initiating the so called reverse air lift circulation. In this circulation method, liquid from the borehole annulus flows around the sides of the bit and then across the bottom to return up the inner passage. The water level in the borehole annulus is kept at a predetermined level by pumping a sufficient amount of liquid in the hole. The liquid which is pumped with the air down the annular passage flows to the bottom of the bit and is discharged through a plurality of nozzles mounted to the bottom of the cutter support. There it combines with the flow from the borehole annulus to return up the inner passage.

In this prior art method, the nozzle discharge is used primarily to create turbulence for suspending the cuttings. The suspended cuttings are not swept toward the intake by the nozzles, rather are swept toward the intake by the major flow of liquid from the borehole annulus. Consequently, the nozzles are oriented in various directions and positioned at various points about the cutter support plate to discharge against the borehole for maintaining the particles in suspension.

Other prior art methods of cleaning the borehole of cuttings are shown in U.S. Pat. Nos. 3,297,100 and 3,360,061. U.S. Pat. No. 3,297,100 discloses a large diameter bit having nozzles directed vertically downward for discharging liquid to suspend the cuttings in the turbulence. U.S. Pat. No. 3,360,061 teaches the circulation of gas through nozzles to sweep cuttings into a scoop for returning up the inner passage.

The prior art devices have need for improvement. It would be beneficial for example to increase the efficiency of cuttings removal to reduce wear on the cutters and increase penetration rates.

SUMMARY OF THE INVENTION

It is accordingly a general object of this invention to provide an improved means for removing cuttings in large diameter earth boring.

It is a further object of this invention to utilize the nozzles of a large diameter earth boring bit for sweeping or aiding the sweep of the cuttings to the intake.

It is a further object of this invention to position the nozzles of a large diameter earth boring bit so that their discharges combine to create a continuous jet stream moving toward the intake for efficiently removing the cuttings.

In accordance with these objects, a drill bit is provided that has at least one outer zone nozzle positioned at the periphery of the cutter support plate. This outer zone nozzle is directed toward the wall slightly above the edge of the borehole for moving cuttings from the gage area inward. A series of inner zone nozzles are positioned at selected radial and circumferential intervals between the periphery and the intake. These inner zone nozzles are oriented generally inward and spaced apart a distance selected so that the area of influence of one nozzle overlaps the area influence of the next adjacent inner zone nozzle. Each inner zone nozzle also points in a generally radial direction but ahead of the next inward zone nozzle, considering the direction of rotation, to pass cuttings onto the next inner zone nozzle. The outermost inner zone nozzle receives cuttings from the outer nozzle and sweeps them onto the next inner zone nozzle. The innermost inner zone nozzle discharges against the bottom near the edge of the intake. The discharges of the inner zone nozzles combine to create a continuous jet stream extending across the borehole face. The jet stream picks up cuttings and moves them continuously toward the intake, independent of the major flow from the borehole and creates what may be visualized as an effective and efficient hydraulic scraper.

DESCRIPTION OF THE PREFERRED EMBODIMENT

Figure 2:
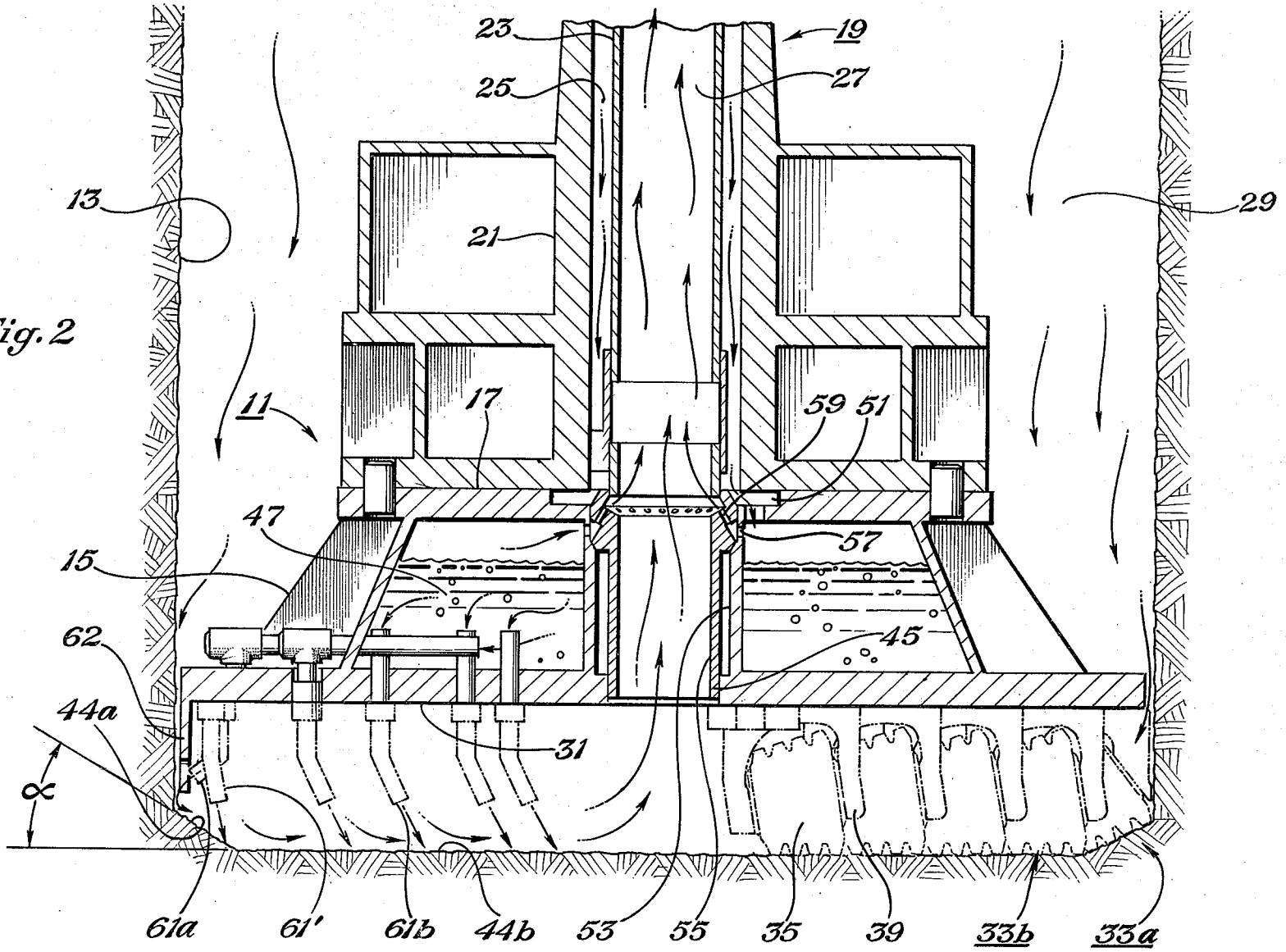
FIG. 2 is a vertical sectional view of the drill bit of FIG. 1, with the cutters and nozzles shown in phantom, and rotated into the plane of the section to show their respective distances from the center of the drill bit.

Referring to FIG. 2, a large diameter earth boring bit 11 is shown in a borehole 13. Bit 11 has a body 15 with a connection plate 17 at the top for connecting the bit to a string of dual concentric drill pipe 19. Drill pipe 19 has an outer pipe 21 and an inner pipe 23, defining a pipe annular passage 25 between the pipes and an inner passage 27 inside inner pipe 23. The annular space between outer pipe 21 and the wall of borehole 13 defines a borehole annulus 29.

A cutter support plate 31 is located at the bottom of the bit body 15. As shown also in FIG. 1, cutter support plate 31 is generally circular and serves as means for supporting a plurality of cutter assemblies 33. Each cutter assembly 33 comprises a frusto-conical cutter 35 mounted on an axle 37 carried by a frame or yoke 39. The cutters 35 have rows of teeth 41 on the surface. The teeth 41 may be steel projections formed on the surface, or tungsten carbide inserts secured in interferring holes. Each cutter axle lies on a radial line from the center of cutter support plate 31, which coincides with the axis of the drill pipe 19.

On the periphery of the cutter support plate 31, six of the cutter assemblies, designated as **33*a*, are positioned for cutting the gage area or outer zone of the borehole 13**. The remaining ten inner cutter assemblies, designated as 33*b*, are positioned between the center cutters 43 of the cutter support plate 31 and the outer zone cutter assemblies 33*a*. FIG. 2 illustrates the path of revolution of all of the cutters, except the two inner conical cutters 43, showing their respective distances from the center of the bit and the portion of the borehole bottom that they cut. The outer zone cutter assemblies 33*a* are mounted so as to cut the bottom portion 44*a* at an angle $\alpha$ with respect to the circular inner zone portion 44*b* of the borehole bottom. Angle $\alpha$ is in the range from 25 degrees to 35 degrees and for the bit shown, preferably 25 degrees. The inner zone portion 44*b* is perpendicular to the drill bit axis.

Cutter support plate 31 has an intake port 45 in its center that communicates the area below the bit with inner passage 27. Bit body 15 has a separation chamber 47 within it between connection plate 17 and cutter support plate 31. A port 51 communicates the annular passage 25 with the separation chamber 47. Chamber 47 has an inner cylindrical wall 53 within which a cylindrical diffuser 55 is mounted. A plurality of ports 57, 59 are formed in the cylindrical wall 53 and diffuser 55 respectively for allowing the passage of air from the chamber 47 to the pipe inner passage 27, as will be explained in more detail subsequently.

Figure 1:
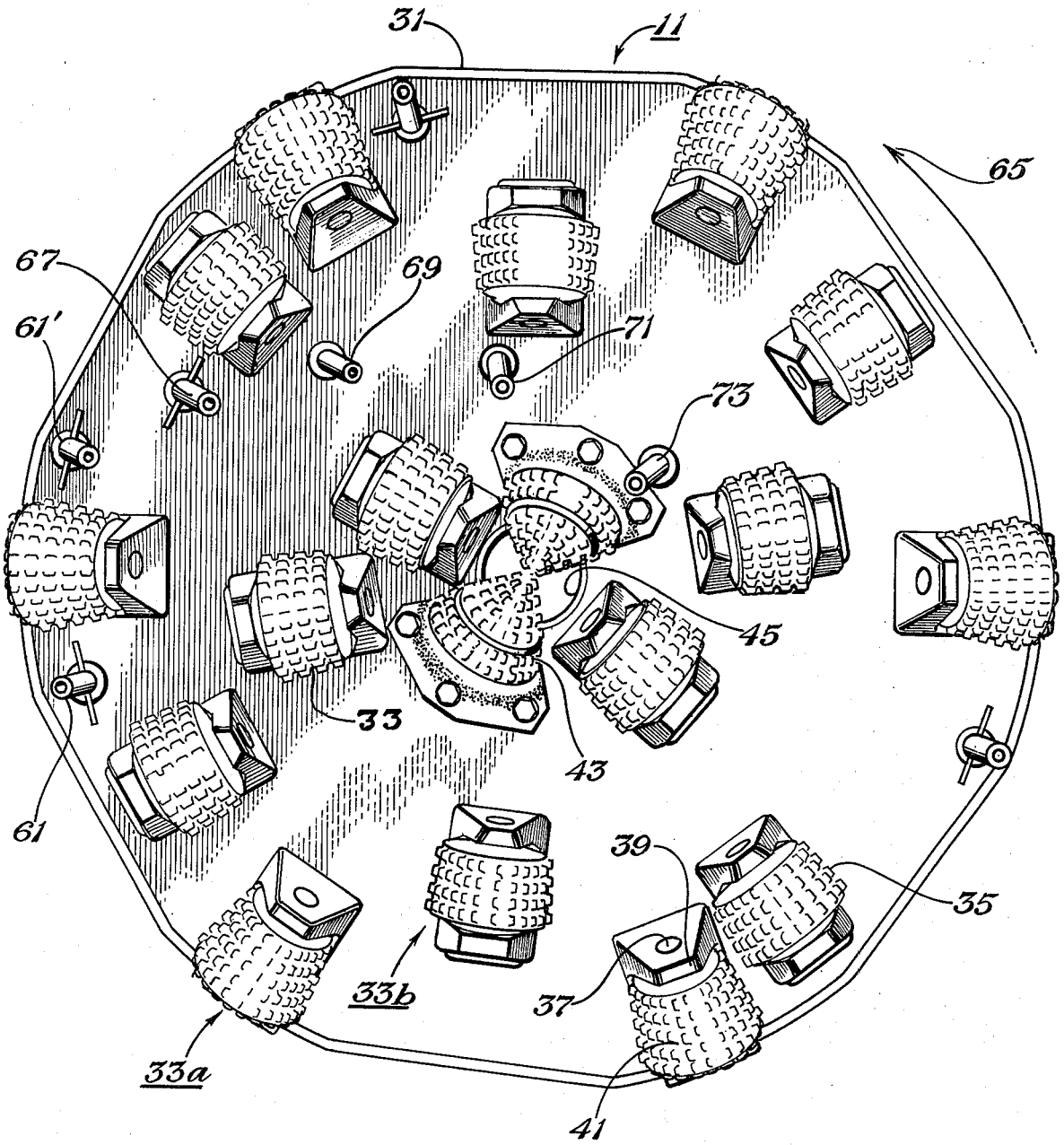
FIG. 1 is a bottom view of an earth boring drill bit constructed in accordance with this invention.

A plurality of nozzles are mounted to the bottom of the cutter support plate 31. Nozzles extend through plate 31, with their open tops extending into, or being in communication with, chamber 47. As shown in FIG. 1, four of the nozzles are mounted at the periphery of the cutter support plate 31 for discharging against the outer zone 44*a*. These outer zone nozzles, designated as 61, serve to wash cuttings from the outer zone into the inner zone of the borehole. As shown in FIGS. 1 and 2, three of the outer zone nozzles 61 have ends that are oriented outward along a radial line and inclined at approximately an angle of 25 degrees with respect to the vertical. A skirt or shroud 62 surrounds and depends from support plate 31. These outer zone or gage nozzles 61 are adapted to discharge liquid below the skirt 62 against the borehole wall generally at or approximately one to two inches above the gage point. The skirt 62 has slots cut into its lower edge for placement of the nozzles 61. The gage point is the intersection of the outer zone portion 44*a* with the wall of the hole.

One of the outer zone nozzles, designated as 61', is mounted with its end oriented so as to discharge on outer zone portion 44*a* one to two inches above the intersection with inner zone 44*b*, for cleaning this intersection of cuttings. Preferably it inclines generally inward about 10° from vertical.

Four inner zone nozzles 67, 69, 71 and 73 are mounted to cutter support plate 31 between the periphery and the intake port 45 for discharging against the inner zone 44*b*. The ends of the inner zone nozzles are inclined at an angle that is 25 degrees with respect to the vertical axis of the bit.

Each nozzle, whether inner or outer zone, has a zone or area of influence. Water discharges from the nozzle in a diverging conical pattern. It impinges the borehole bottom and deflects outward, cleaning an area that is larger than the actual area that the water impinges. This larger area, referred to as the area of influence, is defined herein to be the area of the borehole bottom that a nozzle will clean with the bit in a static, nonrotating and nonsubmerged condition. If the nozzle is pointed downward, it will clean a circular area from the borehole bottom. If inclined, it will clean a slightly elliptical area of generally the same size, for angles up to 50 degrees from vertical. The specific area cleaned depends upon the nozzle diameter and flow rate for typical cuttings.

Whether a nozzle is considered an inner zone nozzle or an outer zone nozzle depends on the point where the center of the discharging liquid impinges the borehole bottom. If the center of the discharge or the area of influence is in the outer zone 44*a* then the nozzle will be considered an outer zone nozzle regardless of its precise position on the cutter support plate 31, and regardless of whether its zone of influence overlaps from one zone to the other.

Figure 3:
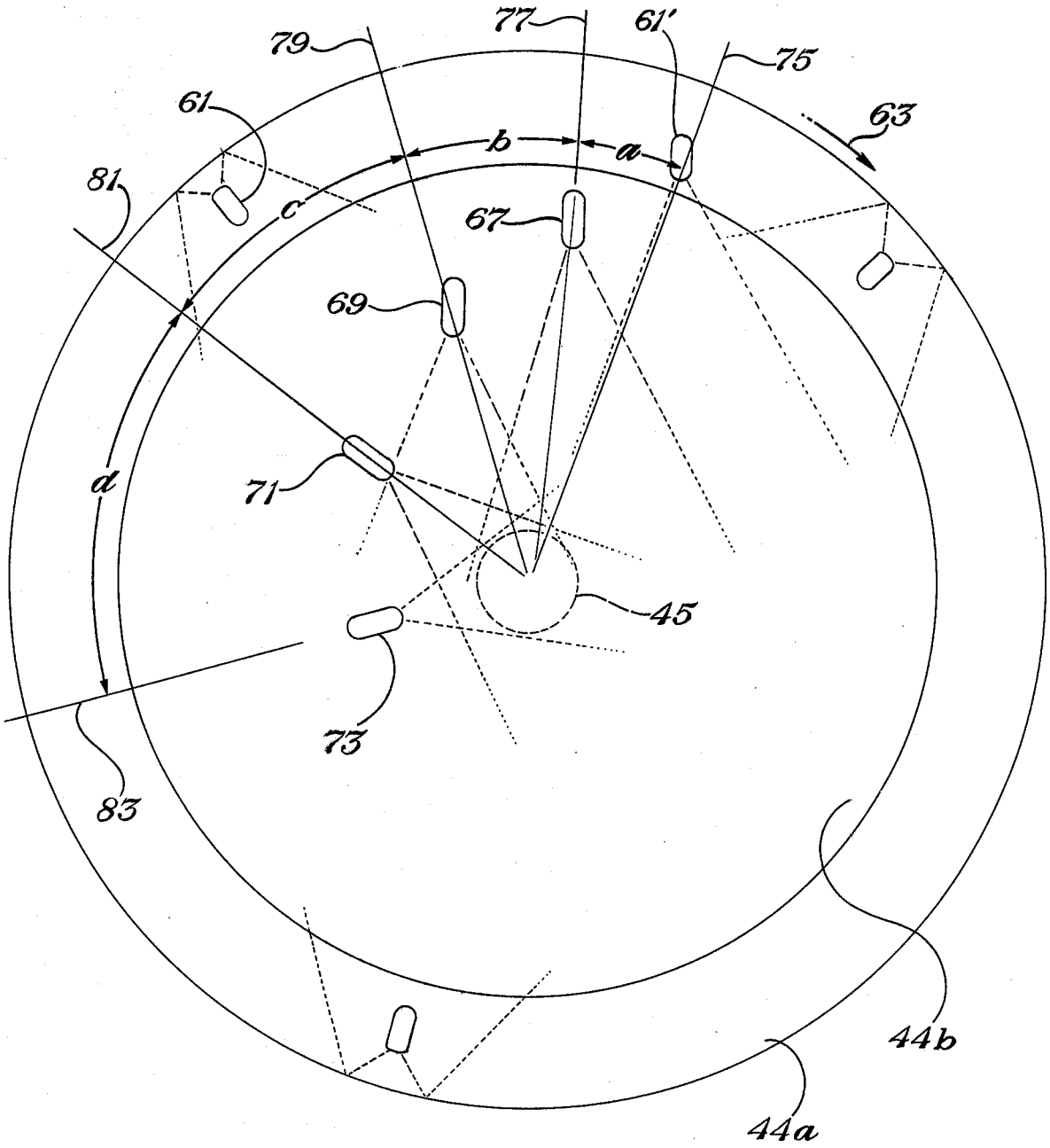
FIG. 3 is a schematic view of the bottom of a borehole, also illustrating schematically the overlapping discharge of nozzles positioned in accordance with the teachings of this invention.

The inner zone nozzles are positioned so that their areas of influence will overlap to form a continuous jet stream along the bottom of the borehole from the outer zone to the intake. The schematic representation of FIG. 3 illustrates that the object of the nozzle positioning is to pick up the cuttings and move them continuously inward to the area below the intake, where they are drawn up into the inner pipe passage 27. In order to accomplish this, not only must the areas of influence overlap, but the rotation must also be considered. Rotation is clockwise, when looking down, as shown by the arrow 63 in FIG. 3, or arrow 65 in FIG. 1. Consequently each inner zone nozzle should be oriented so that its area of influence is forwardly of, or leads the area of influence of the next inward nozzle. Also, each inner zone nozzle must be oriented generally inward toward the intake 45, but not all on radial lines, to direct the flow within the continuous jet stream or hydraulic scraper toward the intake.

The outermost inner zone nozzle 67 should be positioned sufficiently near the outer zone to receive cuttings pushed inward by the outer zone nozzles 61 and 61'. Outer zone nozzle 61' points forwardly of its radial line 75 about 20°, and its area of influence overlaps the area of influence of the outermost inner zone nozzle 67. Inner zone nozzle 67 is oriented generally parallel with outer nozzle 61', making inner nozzle 67 point about 5° forward of its radial line 77. Inner nozzle 67 is positioned rearward or lags the radial line 75, which passes through the outer zone nozzle 61'. The area of influence of the inner zone nozzle 67 leads and overlaps the area of influence of its nearest inward nozzle 69, as shown schematically by FIG. 3. Inner nozzle 69 points along a line generally parallel with inner nozzle 67 and outer nozzle 61', making inner nozzle 69 point about 25° rearwardly of its radial line 81. The area of influence of inner nozzle 69 overlaps the area of influence of the next inward zone nozzle 71. Inner zone nozzle 71 points along its radial line 81 and its area of influence overlaps the innermost inner zone nozzle 73. Inner zone nozzle 73 is also pointed along its radial line 83 and is close enough to the intake 45 so that its area of influence extends substantially below intake 45. It is believed that inner nozzle 71 could serve as the innermost nozzle with inner nozzle 73 being eliminated, however the presence of inner nozzle 73 is not believed to be detrimental.

In operation, the drill pipe 19 is rotated counterclockwise as seen in FIG. 1 by the drill rig to turn the bit. Compressed air and water are pumped down the pipe annular passage 25. Air and water enters the separation chamber 47 through port 51. Air passes from the chamber 47 into the inner passage 27 through ports 57 and 59. Water fills the lower part of chamber 47 and discharges against the borehole bottom through the nozzles. The chamber 47 serves as means for preventing air from being discharged out the nozzles with the liquid. The water returns through intake port 45 and inner passage 27. Water also is maintained in the borehole annulus 29. As indicated by the arrows, this liquid passes around the sides of the bit and flows up inner passage 27 along with water from the discharge of the nozzles.

As shown in FIGS. 2 and 3, cuttings are swept inward, primarily by the overlapping nozzles, to the vicinity of the intake port 45 where they are drawn upward. The outer zone nozzles 61 and 61' push the cuttings out of the outer zone into the inner zone, where they are picked up by the inner zone nozzles 67, 69, 71 and 73, and propelled inward. Preferably a cutting does not cease movement once picked up by the stream created by nozzles.

Laboratory tests utilizing nozzles that discharge against a tank to sweep cuttings into a central hole in the bottom of the tank were conducted. These tests show that the overlapping nozzle array, as described, is superior to various known patterns and others. Most of the cuttings would be cleaned up after less than two revolutions, while other patterns either failed to remove a substantial part of the cuttings, or required 8 to 10 revolutions to remove the cuttings.

Also, an actual bit was constructed similar to that shown in FIG. 1. It performed successfully in the field under actual drilling conditions. While a direct comparison has not yet been made, the described array is believed to have been more effective than the prior art nozzle placement. The bit used in the field was 94 inches in diameter and its nozzles were located with their lower ends six inches off the bottom. Assuming radial line 75, which passes through nozzle 61' to be zero degrees, the discharge end of the outermost inner zone nozzle 67 was spaced rotationally rearward of or lagged outer zone nozzle 61' by an angle a of 14 degrees, as shown in FIG. 3. The next three inner zone nozzles lagged each other by the following: angle b of 26 degrees; angle c of 33 degrees; angle d of 51 degrees, respectively. Radial lines 75 and 81 thus intersect each other at an acute angle of 73 degrees. The distance in inches to the discharge end of each inner nozzle from the bit axis was respectively: 32 inches, 24 inches, 16 inches, and 12 inches. This bit was adapted to use nozzles of diameter sizes varying from ½ inch to ¾ inch. The bit was constructed to be operated on rigs at 10 to 20 rpm (revolutions per minute), preferably around 13 rpm, with water being pumped in at the surface in the range from 150 psi to 250 psi (pounds per square inch), with 345 to 445 gpm (gallons per minute), of water and 970 to 1200 scfm (cubic feet per minute at atmospheric pressure), of air being pumped. Expected areas of influence under these conditions are approximately 15 to 25 inches in diameter.

It should be apparent that an invention having significant advantages has been provided. The nozzle arrangement described above provides improved cleaning. The cleaning of cuttings is accomplished by nozzle discharge, rather than flow from the borehole annulus. The combined discharge creates an inward flowing hydraulic scraper that quickly removes the cuttings. This results in greater penetration rate and cutter life.

While the invention has been shown in only one of its forms, it should be apparent to those skilled in the art that it is not so limited but susceptible to various changes and modifications without departing from the spirit thereof.

I claim:

1. In a drill bit for drilling a borehole in the earth of the type having cutter support means, a plurality of rotatable cutters mounted to the cutter support means for cutting an annular outer zone at the periphery of the borehole and a circular inner zone bounded by the outer zone, connection means for connecting the cutter support means to a string of drill pipe having at least one input and one return flow passage extending from the drill bit to the surface for pumping fluid to the drill bit and returning fluid and cuttings to the surface, and an intake port in the cutter support means in communication with the return flow passage for transmitting cuttings to the return flow passage, an improved nozzle means for discharging fluid from the input passage against the borehole, comprising:

at least one outer zone nozzle mounted adjacent the periphery of the cutter support means, the outer zone nozzle being in communication with the input passage and pointed so that the center of its discharge strikes the outer zone; and a plurality of inner zone nozzles spaced at selected points on the cutter support means and pointed so that the centers of their discharges strike the inner zone, one of the inner zone nozzles being located near the outer zone nozzle, another inner zone nozzle near the intake port, and at least one inner zone nozzle spaced between, the outer zone nozzle and each inner zone nozzle having a nonrotating area of influence, the area of influence of the outer zone nozzle leading, being further outward, and overlapping the area of influence of the nearest inward inner zone nozzle, the area of influence of each inner zone nozzle leading, being further outward, and overlapping the area of influence of its nearest inward inner zone nozzle, the area of influence of the inner zone nozzle closest to the intake port extending below the intake port, to create a continuous stream flowing from the periphery of the borehole to the intake port.

2. In a drill bit for drilling a borehole in the earth of the type having cutter support means, a plurality of rotatable cutters mounted to the cutter support means for cutting an annular outer zone at the periphery of the borehole, and a circular inner zone bounded by the outer zone, connection means for connecting the cutter support means to a string of drill pipe having concentric inner and outer pipes that extend from the drill bit to the surface with an annular passage for pumping fluid to the drill bit and an inner passage for returning fluid and cuttings, and an intake port in the cutter support means in communication with the inner passage for returning cuttings, an improved nozzle means for discharging fluid from the annular passage against the borehole, comprising:

at least one outer zone nozzle mounted adjacent the periphery of the cutter support means, the outer zone nozzle being in communication with the annular passage and pointed so that the center of its discharge strikes the outer zone;

an outermost inner zone nozzle in communication the annular passage and mounted to the cutter support means with its discharge end further inward from and lagging the outer zone nozzle;

at least one intermediate inner zone nozzle in communication with the annular passage and mounted to the cutter support means with its discharge end lagging and being further inward from the outermost inner zone nozzle; and an innermost inner zone nozzle in communication with the annular passage and mounted to the cutter support means with its discharge end adjacent the intake port and lagging the intermediate inner zone nozzle, the innermost inner zone nozzle being pointed toward the borehole bottom below the intake port;

each inner zone nozzle having a nonrotating area of influence that is further outward and leading the area of influence of its nearest inward inner zone nozzle, but overlapping, the outer zone nozzle having a nonrotating area of influence that leads, is further outward, and overlaps the area of influence of the outermost inner zone nozzle, to create a continuous stream flowing from the periphery of the borehole to the intake port.

3. In a drill bit for drilling a borehole in the earth of the type having cutter support means, a plurality of rotatable cutters mounted to the cutter support means for cutting an annular outer zone at the periphery of the borehole and a circular inner zone bounded by the outer zone, connection means for connecting the cutter support means to a string of drill pipe having concentric inner and outer pipes that extend from the drill bit to the surface with an annular passage for pumping liquid to the drill bit and an inner passage for returning liquid and cuttings, means for pumping gas into the inner passage to reduce the weight of the liquid in the inner passage and cause circulation, an intake port in the cutter support means in communication with the inner passage, nozzle means for discharging liquid from the annular passage against the borehole, and means for preventing the gas from being discharged out the nozzle means, the nozzle means comprising:

an outer zone nozzle mounted adjacent the periphery of the cutter support means, the outer zone nozzle being in communication with the annular passage and pointed so that the center of its discharge strikes the outer zone;

an array containing inner zone nozzles mounted to the cutter support means in communication with the annular passage and pointed so that the centers of their discharges strike the inner zone; the outermost inner zone nozzle in the array pointing generally inward and being located further inward from and lagging the outer zone nozzle by an acute angle;

at least one intermediate inner zone nozzle in the array in communication with the annular passage and mounted to the cutter support means with its discharge end located further inward from and lagging the outermost inner zone nozzle by an acute angle;

an innermost inner zone nozzle in the array in communication with the annular passage and mounted to the cutter support means with its discharge end adjacent the intake port, lagging the intermediate inner zone nozzle by an acute angle, and pointed toward the borehole bottom below the intake port;

each inner zone nozzle in the array pointing generally inward and to a point on the borehole bottom that is leading and further outward from its nearest inward inner zone nozzle, but sufficiently close so that the discharges overlap to form a continuous stream flowing from the periphery of the borehole to below the intake port to sweep cuttings into the intake port;

the cutter support means being free of any nozzles directed inward other than those in the array.

4. In a drill bit for drilling a borehole in the earth of the type having cutter support means, a plurality of rotatable cutters mounted to the cutter support means for cutting an annular outer zone at the periphery of the borehole and a circular inner zone bounded by the outer zone, connection means for connecting the cutter support means to a string of drill pipe having concentric inner and outer pipes that extend from the drill bit to the surface with an annular passage for pumping liquid to the drill bit and an inner passage for returning liquid and cuttings, means for pumping gas into the inner passages to reduce the weight of the liquid in the inner passage and cause circulation, an intake port in the cutter support means in communication with the inner passage, nozzle means for discharging liquid from the annular passage against the borehole, and means for preventing the gas from being discharged out the nozzle means, the nozzle means comprising;

an outer zone nozzle mounted adjacent the periphery of the cutter support means, the outer zone nozzle being in communication with the annular passage and pointed so that the center of its discharge strikes the outer zone;

a first inner zone nozzle in communication with the annular passage and mounted to the cutter support means with its discharge end further inward from the outer zone nozzle;

a second inner zone nozzle in communication with the annular passage mounted to the cutter support means with its discharge end further inward and lagging the first inner zone nozzle;

a third inner zone nozzle in communication with the annular passage, mounted to the cutter support means with its discharge end further inward from and lagging the second inner zone nozzle; radial lines passing through the discharge ends of the first inner zone nozzle and the third inner zone nozzle intersecting each other at an acute angle with the second inner zone nozzle located therebetween;

the first, second, and third inner zone nozzles all pointing generally inward and oriented so that they have nonrotating areas of influence that overlap to form a continuous stream from the periphery of the borehole to below the intake port to sweep cuttings into the intake port.

5. A drill bit for drilling a borehole in the earth comprising in combination:

a cutter support;

connection means for connecting the cutter support to a string of drill pipe having inner and outer pipes that extend to the surface with an annular passage and an inner passage;

the annular passage being adapted to receive downwardly flowing liquid and the inner passage being adapted to return the liquid along with the cuttings;

means for pumping gas into the inner passage to reduce the weight of the liquid in the inner passage and cause circulation;

an intake port in the cutter support in communication with the inner passage;

a plurality of outer zone cutters mounted adjacent the periphery of the cutter support for cutting an annular outer zone at the periphery of the borehole, the outer zone being inclined with respect to the axis of the drill pipe;

a plurality of inner zone cutters mounted to the cutter support inward from the outer zone cutters for cutting a circular inner zone of the borehole bounded by the outer zone;

a first outer zone nozzle in communication with the annular passage, mounted adjacent the periphery of the cutter support and pointed toward the wall of the borehole;

a second outer zone nozzle in communication with the annular passage, mounted adjacent the periphery of the cutter support and pointing so that the center of its discharge strikes the outer zone;

a first inner zone nozzle in communication with the annular passage, mounted to the cutter support with its discharge end further inward from and lagging the second outer zone nozzle, and pointing generally toward the intake port;

a second inner zone nozzle in communication with the annular passage, mounted to the cutter support with its discharge end further inward from and lagging the first inner zone nozzle, and pointing generally toward the intake port;

a third inner zone nozzle in communication with the annular passage, mounted to the cutter support with its discharge end further inward from and lagging the second inner zone nozzle, and pointing generally toward the intake port; radial lines passing through the discharge ends of the third inner zone nozzle and the second outer zone nozzle intersecting each other at an acute angle with the first and second inner zone nozzles located therebetween;

the discharges of the second outer zone nozzle and the first, second, and third inner zone nozzles being oriented so that they have nonrotating areas of influence that overlap to form a continuous stream from the periphery of the borehole to the intake port; and means for preventing the gas from being discharged out the inner and outer zone nozzles with the liquid.

6. A drill bit for drilling a borehole in the earth comprising in combination:

a cutter support;

connection means for connecting the cutter support to a string of drill pipe having inner and outer pipes that extend to the surface with an annular passage and an inner passage;

the annular passage being adapted to receive downwardly flowing liquid and the inner passage being adapted to return the liquid along with the cuttings;

means for pumping gas into the inner passage to reduce the weight of the liquid in the inner passage and cause circulation;

an intake port in the cutter support in communication with the inner passage;

a plurality of outer zone cutters mounted adjacent the periphery of the cutter support for cutting an annular outer zone at the periphery of the borehole, the outer zone being inclined with respect to the axis of the drill pipe;

a plurality of inner zone cutters mounted to the cutter support inward from the outer zone cutters for cutting a circular inner zone of the borehole bounded by the outer zone;

a first outer zone nozzle in communication with the annular passage, mounted adjacent the periphery of the cutter support and pointed toward the wall of the borehole;

a second outer zone nozzle in communication with the annular passage, mounted adjacent the periphery of the cutter support and pointing so that the center of its discharge strikes the outer zone;

a first inner zone nozzle in communication with the annular passage, mounted with its discharge end further inward from and lagging the second outer zone nozzle, and pointing generally toward the intake port;

a second inner zone nozzle in communication with the annular passage, mounted to the cutter support with its discharge end further inward from and lagging the first inner zone nozzle, and pointing in a direction parallel with the first inner zone nozzle;

a third inner zone nozzle in communication with the annular passage, mounted to the cutter support with its discharge end further inward from and lagging the second inner zone nozzle, and pointed generally toward the inner zone below the intake port;

radial lines passing through the discharge ends of the third inner zone nozzle and the second outer zone nozzle intersecting each other at an acute angle, with the first and second inner zone nozzles located therebetween, for combining the discharges to create a continuous stream flowing from the periphery of the borehole to the intake port; and means for preventing the gas from being discharged out the inner and outer zone nozzles with the liquid.

* * * * *